US006651812B2

(12) United States Patent
Man

(10) Patent No.: US 6,651,812 B2
(45) Date of Patent: Nov. 25, 2003

(54) GOLD CLUB SUPPORT MEANS

(75) Inventor: Simon Chu Yuk Man, Shatin (HK)

(73) Assignee: Sino Golf Manufacturing Co., Ltd., Hong Kong (HK)

( * ) Notice: Subject to any disclaimer, the term of this patent is extended or adjusted under 35 U.S.C. 154(b) by 0 days.

(21) Appl. No.: 10/147,927

(22) Filed: May 20, 2002

(65) Prior Publication Data

US 2003/0192797 A1 Oct. 16, 2003

(30) Foreign Application Priority Data

Apr. 16, 2002 (GB) ..... 0208705

(51) Int. Cl.[7] ..... A63B 55/00

(52) U.S. Cl. ..... 206/315.3; 206/315.4; 206/315.5

(58) Field of Search ..... 206/315.2, 315.3, 206/315.4, 315.5

(56) References Cited

U.S. PATENT DOCUMENTS 2,879,819 A * 3/1959 Turnbull ..... 206/315.2
5,458,240 A * 10/1995 Rich et al. ..... 206/315.3
5,775,513 A * 7/1998 Anthony ..... 206/315.3
5,853,086 A * 12/1998 Chang ..... 206/315.6
6,202,840 B1 * 3/2001 Chang ..... 206/315.4
6,328,161 B1 * 12/2001 Kang ..... 206/315.3

* cited by examiner

*Primary Examiner*—Tri M. Mai
(74) *Attorney, Agent, or Firm*—Nixon Peabody LLP; Jeffrey L. Costellia

(57) ABSTRACT

A support means for golf clubs comprising four parts. The first, second and third parts having a plurality of recesses for the golf club heads, the third part also being a cover for the golf club heads in the recesses of the first part and the second part. The fourth part of the cover providing a final cover to protect the golf clubs from dust and scratching. A cover so arranged has the advantage of fixing the position of various golf clubs (irons and woods) in a golf club bag. The golf clubs are held in position in the bag so that they will not scratch one another and making noises when being carried. The four parts of the cover are of transparent polymer material to allow the golf clubs to be seen through the cover which is advantageous for displaying purposes in shops.

14 Claims, 2 Drawing Sheets

GOLD CLUB SUPPORT MEANS

The present invention relates to support means for golf clubs, and in particular to a support means adapted to fit to the mouth of a golf club bag.

It is known to provide individual covers for golf clubs in a golf club bag. Typically each cover is a sock of material that is required to be removed and refitted each time a golf club is used. The socks prevent the clubs scratching one another and protect the golf club heads from dust.

Several problems are associated with the prior art golf club covers. Firstly they may be time consuming and awkward to fit and remove. Once removed they may be misplaced if they are not secured to the golf club bag or stored in a convenient place. Secondly when the covers are fitted the golf clubs cannot be seen. This may be problematic when selecting a particular golf club to use or when the golf clubs are on display in a shop.

A further problem associated with the prior art golf club covers is that they do not inhibit the clubs moving around in the golf club bag. This may allow the clubs to collide with one another which can lead to unwelcome noise and the possibility of clubs damaging one another during transit.

What is required is a golf club support means which can overcome the aforementioned problems.

According to a first aspect of the invention there is provided a golf club support means adapted to fit to the mouth of a golf bag, said support means comprising a body having a plurality of formations shaped to, in use, receive and support a plurality of golf clubs in spaced relation to one another.

The support means of the present invention has the advantage of fixing the position of various golf clubs (irons and woods) in a golf club bag. The golf clubs are held in position in the bag so that they will not collide with or scratch one another and make noises when being carried.

In a preferred embodiment the formations are shaped to receive and support golf club heads, in use. Advantageously the formations, comprise a plurality of spaced ridges. This arrangement supports the golf club heads so that, in use, the shafts are substantially suspended within the golf club bag.

Preferably the body includes at least one recess, shaped to accommodate a golf club shaft, in use. The body may be provided with a plurality of recesses positioned so as to each receive a single club shaft. Alternatively the body may be provided with a single recess adapted to receive a plurality of club shafts.

Advantageously the body is moulded from a plastics material. The body may be moulded in any suitable manner including, for example, a rotation moulding operation, a vacuum forming operation or an injection moulding operation. In a preferred embodiment the body comprises a contoured skin of plastics material formed by injection moulding. Such a skin of plastics material provides the necessary rigidity to the body to support the golf clubs while remaining light and easy to manufacture. In an alternative embodiment the body may be manufactured from an expanded or foamed plastics material.

In a preferred embodiment the support means includes a cover adapted to overlie the body, in use. The cover serves to protect golf club heads supported by the body from dust and scratching. Advantageously the cover is provided with a plurality of formations shaped to, in use, receive and support a plurality of additional golf clubs in spaced relation to one another. This allows golf club heads to be placed on top of the cover to provide a further support for more golf clubs.

Preferably the formations of said cover are shaped to receive and support the heads of said additional golf clubs, in use.

Preferably the formations of said cover comprise a plurality of spaced ridges. Advantageously the cover including at least one recess shaped to accommodate a golf club shaft, in use. Preferably the cover is moulded from a plastics material and in a preferred embodiment the cover comprises a contoured skin of plastics material. In a preferred embodiment the cover is at least in part transparent, thereby allowing clubs supported on the body to be viewed.

According to a second aspect of the invention there is provided a golf club support and display means comprising first and second support bodies adapted to fit to the mouth of a golf bag, a combined support body and cover having a recess adapted, in use, to receive said first and second support bodies and a top cover having a recess adapted, in use,to receive said combined support body and cover, said first and second support bodies being provided with a plurality of formations shaped to, in use, receive and support a plurality of golf clubs in spaced relation to one another.

The first and second support bodies may be separate or attentively may be joined, for example by a living hinge. Preferably the first and second support bodies, in use, project at differing heights from the mouth of the golf bag and, in use, present golf clubs supported thereon in a stepped array.

In a preferred embodiment the covers and support bodies may be manufactured from a transparent polymer material. This has the advantage of allowing the golf clubs to be seen through the support which is advantageous for displaying purposes in shops.

In a preferred embodiment the combined support body and cover is provided with one or more formations which enable the support body and cover to be attached to a golf bag, in use. Said formations may comprise a plurality of tabs having holes for attachment to appropriate features of a golf club bag. Preferably the tabs are flexible and thus allow the combined support body and cover to hinge from the golf bag to allow access to the golf clubs located on the first and second support bodies.

Preferably the second cover has holes for attachment to a golf club bag. This allows the cover to be easily fixed to and detached from the golf bag.

The second cover may be of two piece construction having a skirt and a top which are fixed together. Advantageously the second cover is substantially tubular with a diameter of approximately 25 cm. This allows the second cover to be located onto a golf club bag.

Advantageously the parts of the support bodies and/or covers may be provided with one or more additional recesses to receive golfing equipment. This may be in the form of one or more recesses for golf balls or one or more holes for golf tees.

Advantageously the golf club support means is a plurality of separate parts. This allows the different parts of the support means to be combined at the discretion of the user. For example if fewer golf clubs are placed in the golf bag less parts are needed.

Other features of the invention will be apparent from the following description of a preferred embodiment shown by way of example only in the accompanying drawings, in which.

Figure 1:
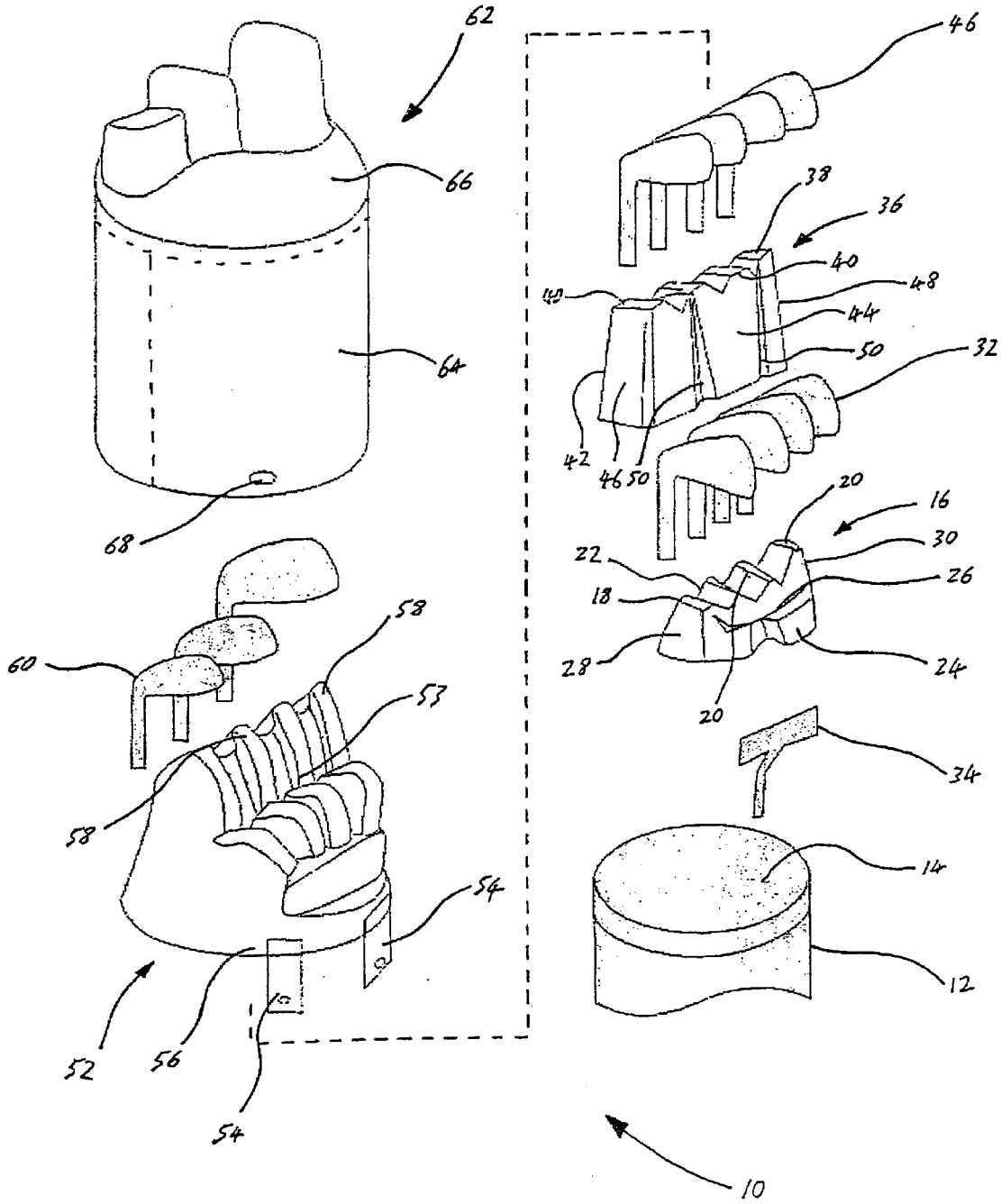
FIG. 1 is an exploded diagrammatic representation of a golf club support means according to the present invention.

Referring firstly to FIG. 1 there is shown a golf club support means in accordance with the present invention, generally designated 10 and comprising a first support body 16, a second support body 36, a combined support body and cover 52 and a second cover 62. The figure shows a golf club bag 12 with a conventional opening 14 or mouth onto which the first support 16 locates. The first support 16 comprises a top 18 with a plurality of spaced ridges 20, a back 22 over which the ridges 20 extend, a front 24 having a recess 26 and sides 28, 30 which connect the top 18, the back 22 and the front 24 of the support body 16. The ridges 20 are spaced and shaped such that they can receive and support the heads of the shorter golf clubs 32 of a set, that is to say irons having higher numbers. The head of a putter 34 locates in the recess 26 on the front 24 of the part 16. In the embodiment shown the first support body 16 is hollow and moulded from a sheet of plastics material.

Also shown in FIG. 1 is a second support body 36 which similarly comprises a top 38 with ridges 40, a back 42 over which the ridges 40 extend, a front 44 and, sides 46, 48 which connect the top 38, the back 42 and the front 44. The ridges 40 are spaced and shaped such that the heads 46 of the relatively longer golf clubs 46 (irons with lower numbers) may be located therebetween, in use. Recesses 50 are provided in the front 44 of the second body 36 so as to accommodate the shafts of golf clubs 32 located in the first support body 16, in use.

It will be noted that the second support body 36 is comparatively taller than the first body 16 so as to present the clubs supported in the bodies 16,36 in a stepped arrangement. In the embodiment shown the second support body 36 is hollow and moulded from a sheet of transparent plastics. The first and second support bodies 16, 36 are shown as separate components, however it will be appreciated that the bodies 16, 36 may be joined, for example by a living hinge.

Also shown in FIG. 1 is a combined support body and cover 52. The cover 52 is hollow and shaped, in use, to receive and accommodate the first supported bodies 16, 36 and golf clubs fitted thereto. The cover 52 has a top 53 with a surface profile to fit the profile of golf club heads 34, 32, 46. The cover 52 has four flaps 54, two of which are shown, on the edge of its sides 56 for the purpose of attaching the cover 52 to the golf bag 12. When only two of the flaps 54 are attached to the golf bag 12 the cover 52 can be hinged so as to allow access to the golf clubs located on the first and second supports 16, 36. The outside surface of the top 53 of the cover 52 has ridges 58 adapted to receive and support the golf club heads of bigger and longer golf clubs 60 (woods). In the embodiment shown the first cover 52 is moulded from a sheet of plastics material.

FIG. 1 also shows a second cover 62 adapted to cover and enclose the first and second support bodies 16,36, the combined support body and cover 52 and any golf clubs supported thereby. The second cover 62, in the embodiment shown, is of two piece construction comprising a cylindrical 64 and a top 66 which are joined together along the dotted lines in FIG. 1. The second cover 62 has four holes 68 at the edge of the skirt 64 for attachment to the golf bag 12. The top 6.6 is moulded so as to receive the heads of any clubs supported on the combined support body and cover 52. The second cover 62 is hollow and moulded from a sheet of transparent plastics.

Figure 2:
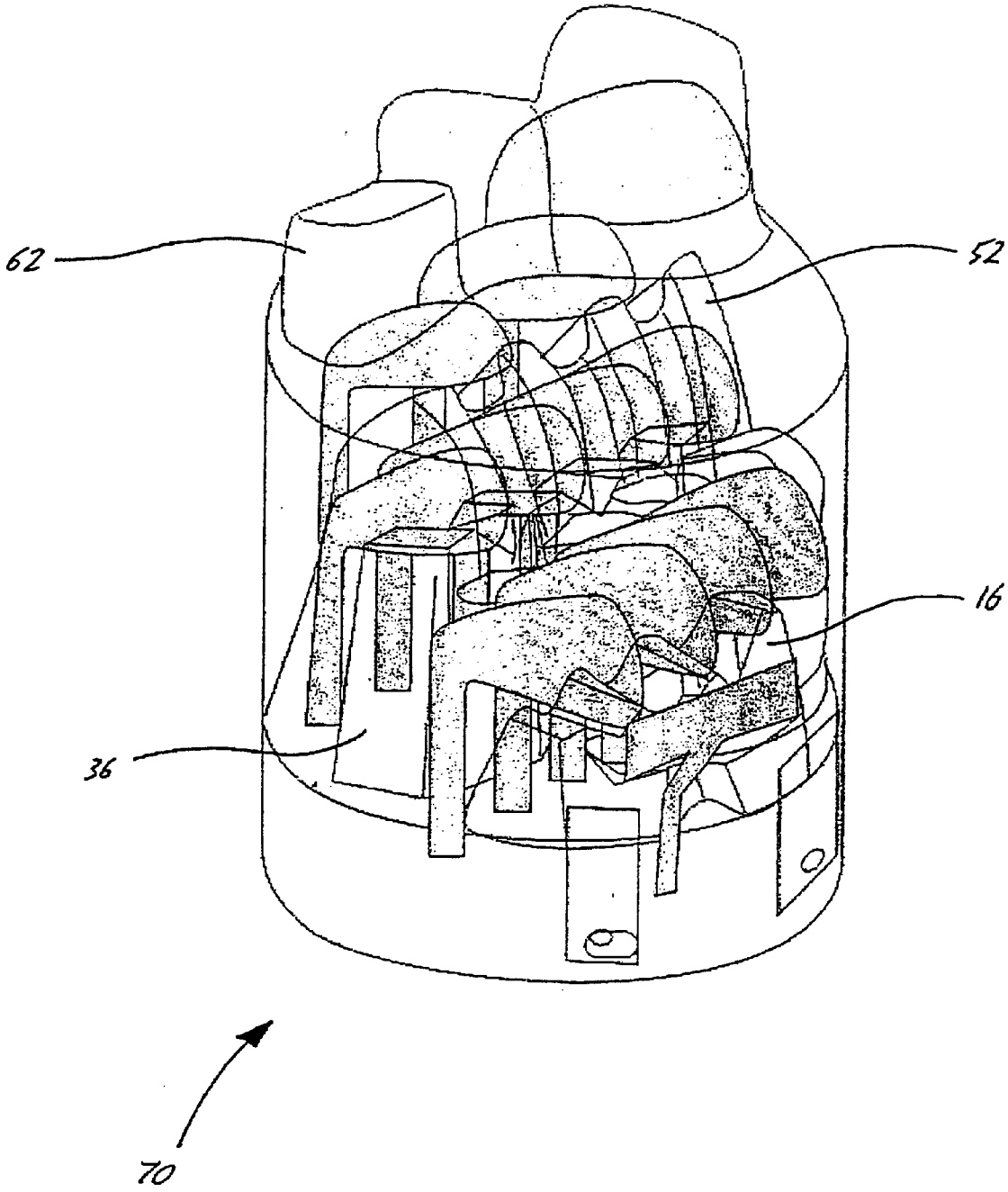
FIG. 2 is a diagrammatic perspective representation of a golf club support means according to the present invention.

FIG. 2 illustrates a perspective view of the golf club support means 10 in a fully assembled state 10 and carrying a full complement of golf clubs. The diagram illustrates the relative orientation of the first support 16, the second support 36, the first cover 52 and second cover 62 when assembled.

In use the support bodies and covers 16, 36, 52, 62 may be used separately, altogether or in different combinations as required and depending on the number of golf clubs being carried. The first support 16 and second support 36 are placed next to each other slightly above the opening 14 of the golf bag 12 to fix the positions of the golf clubs 34, 32, 46 (irons) in a predetermined sequence. Once the required complement of clubs 34, 32, 46 (irons) are located to the first and second support bodies 16, 36, the first cover may be 52 is placed thereon to cover the support bodies 16,36 together with the golf clubs 34, 32, 46 (irons). The woods 60 may then placed in the golf bag 12 so that the heads of the woods 60 locate between ridges 58 of the first cover 52. The second cover 62 is then placed over the clubs 34, 32, 46, 60 and the first support 16, second support 36 and first cover 52.

The shape of the covers and supports 16, 36, 52, 62 are contoured so as to accommodate golf clubs, both irons and woods, from a variety of manufactures. As described above the covers and support bodies 16, 36, 52,62 and are moulded from a relatively thin plastic sheet material. In a preferred embodiment the plastic of the combined support body and cover 52 and the second cover 62 is transparent so as to allow the clubs to be viewed when the covers 52, 62 are in place. This sheet moulding technique provides adequate strength to support the clubs, yet provides a light and easy to handle cover. The diameter of the second cover being approximately equal to the diameter of a golf club bag opening.

Whilst a preferred embodiment for the device has been described it will be appreciated that many other designs of the support means exist that would have the desired effect of the invention with the proviso that parts of the support means support the golf clubs and parts of the support means cover and protect the golf clubs.

What is claimed is:

1. A golf club support and display means comprising:

first and second support bodies adapted to fit to the mouth of a golf bag said first and second support bodies each being provided with a plurality of formations shaped to receive and support a first plurality of golf clubs in spaced relation to one another, a combined support body and cover wherein said combined support body and cover being provided with a plurality of formations shaped to receive and support a second plurality of golf clubs in spaced relation to one another on an exterior surface thereof and shaped to have a recess for covering said first and second support bodies and said first plurality of golf clubs and a top cover having a recess, to cover said combined support body and cover and said second plurality of golf clubs.

2. A golf club support and display means as claimed in claim 1, wherein said plurality of formations of said first and second support bodies and said support body and cover are shaped to receive and support golf club heads.

3. A golf club support and display means as claimed in claim 2, wherein said plurality of formations of said first and second support bodies and said support body and cover comprise a plurality of spaced ridges.

4. A golf club support and display means as claimed in claim 3, wherein said first and second support bodies and said support body and cover are moulded from a plastics material.

5. A golf club support and display means as claimed in claim 4, wherein said first and second support bodies and said support body and cover comprise a contoured skin of plastics material.

6. A golf club support and display means as claimed in claim 1, wherein said plurality of formations of said first and second support bodies and said support body and cover comprise a plurality of ridges.

7. A golf club support and display means as claimed in claim 1, wherein said support body and cover is moulded from a plastics material.

8. A golf club support and display means as claimed in claim 7, wherein said first and second support bodies and said support body and cover comprise a contoured skin of plastics material.

9. A golf club support and display means as claimed in claim 1, wherein said first and second support bodies, project at different heights from the mouth of the golf and, support golf clubs thereon in a stepped array.

10. A golf club support and display means as claimed in claim 1 or claim 9, wherein said combined support body and cover is provided with attaching means which enable the support body and cover to be attached to a golf bag.

11. A golf club support and display means comprising:

first and second support bodies adapted to fit to the mouth of a golf bag, a combined support body and cover having a recess adapted, in use, to receive said first and second support bodies and a top cover having a recess adapted to receive said combined support body and cover, said first and second support bodies being provided with a plurality of formations shaped to, in use, receive and support a plurality of golf clubs in spaced relation to one another, wherein said combined support body and cover is provided with attaching means which enable the support body and cover to be attached to a golf bag, wherein said attaching means comprise at least one tab having a hole for attachment to an appropriate feature of a golf bag.

12. A golf club support and display means as claimed in claim 11, wherein said at least one tab is flexible and thereby allows the combined support body and cover to, hinge from the golf bag to allow access to the golf clubs located in the first and second support bodies.

13. A golf club support and display means as claimed in claim 11, wherein said top cover is of two pieces construction having a skirt and a top which are fixed together.

14. A golf club support and display means as claimed in claim 11, wherein said first and second support bodies are provided with one or more additional recesses to receive golfing equipment.

* * * * *

UNITED STATES PATENT AND TRADEMARK OFFICE

CERTIFICATE OF CORRECTION

PATENT NO. : 6,651,812 B2
DATED : November 25, 2003
INVENTOR(S) : Simon Chu Yuk Man It is certified that error appears in the above-identified patent and that said Letters Patent is hereby corrected as shown below:

Title page, Item [54] and Column 1, line 1,
Title, delete "GOLD CLUB SUPPORT MEANS" insert -- GOLF CLUB SUPPORT MEANS --.

Signed and Sealed this

Fourth Day of May, 2004

JON W. DUDAS
*Acting Director of the United States Patent and Trademark Office*